US006119379A

United States Patent [19]

Hickle et al.

[11] Patent Number: 6,119,379

[45] Date of Patent: Sep. 19, 2000

[54] TEXTILE PRESS WITH AMBIDEXTROUS CLOSING SYSTEM

[75] Inventors: Ernest J. Hickle; Kevin W. Cliff, both of New Market, Tenn.

[73] Assignee: Forenta, L.P., Morristown, Tenn.

[21] Appl. No.: 09/271,726

[22] Filed: Mar. 18, 1999

[51] Int. Cl.[7] ..... D06F 71/04

[52] U.S. Cl. ..... 38/37

[58] Field of Search ..... 38/36, 37, 38, 38/39, 40, 41, 1 C, 1 D; 100/92, 53, 219, 220, 275; 219/250, 256, 489; 307/407, 326

[56] References Cited

U.S. PATENT DOCUMENTS

| | | | |
|---|---|---|---|
| 2,313,918 | 3/1943 | Brownlee . | |
| 2,341,689 | 2/1944 | Bryson . | |
| 2,369,243 | 2/1945 | Lechler . | |
| 2,395,780 | 2/1946 | Devol, Jr. et al. . | |
| 2,556,009 | 6/1951 | Strike | 38/36 |
| 2,948,071 | 8/1960 | Neckel et al. | 38/41 |
| 3,279,106 | 10/1966 | Tucker | 38/40 |
| 3,414,992 | 12/1968 | Dachtler | 38/41 |
| 3,640,007 | 2/1972 | Richterkessing | 38/41 |
| 5,359,792 | 11/1994 | Hanada et al. . | |

*Primary Examiner*—Ismael Izaguirre
*Attorney, Agent, or Firm*—Pitts & Brittian, P.C.

[57] ABSTRACT

A textile press with an ambidextrous closing system for closing and locking a press head against a buck. The textile press is configured with a pair of activators configured such that pressing and holding one of the activators causes the press head to engage the buck. Concurrently pressing the remaining of the pair of activators causes the press head to be locked in position when the press head moves into engagement with the buck. At the end of the timed pressing cycle or when a release activator is activated, the press head returns to the open position.

12 Claims, 2 Drawing Sheets

TEXTILE PRESS WITH AMBIDEXTROUS CLOSING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a system for operating a clothes press in a textile operation. More particularly, this invention relates to a system for opening, closing, and locking the head of a textile press.

2. Description of the Related Art

Numerous types of machines have been provided for the purpose of ironing and pressing garments after washing or dry-cleaning operations. These machines include a press head which closes against a fixed lower surface, known as the buck. Once closed, the machines apply steam, heat, and pressure to smooth, press, and dry the garment. Typical of these modern machines are the power driven machines which employ a pneumatic closing mechanism. When activated, the closing mechanism lowers the press head until it registers against the buck.

Due to the danger these power driven machines pose to an operator who gets a hand caught between the press head and the buck, safety standards have been developed requiring the operator to simultaneously manipulate two activators separated by distance great enough to require the use of both hands in order to effectuate the closing of the press. This requirement is formalized in a standard published by the American National Standards Institute (ANSI) for Commercial Laundry and Drycleaning Operations (ANSI Z8.1–1996). Paragraph 4.4.2.1 relating to presses with stationary bucks requires that "to close the press, continuous pressure on the activating button shall be required to move the press from fully open to closed position. Releasing the activation button shall cause the press to return to its fully open position." Continuing, the standard requires that "[i]n order to lock any laundry or drycleaning press in its closed position . . . , the operator shall have both hands simultaneously on two buttons or levers that cause the locking of the press. A separate . . . button . . . shall be provided within the reach of the operator to release the press locking mechanism and open the press instantly . . . ."

A conventional textile press includes a close button, a lock button, and a release button. The operator is required to press and hold a close button. This activates a fluid operated drive system which lowers the press head until it engages the buck, the closed position. Should the close button be released, the press head returns to the open position. Once the press head achieves the closed position, a lock button must be pressed. When the pressing operation is complete, the textile press opens either automatically or by pressing the release button.

A textile press operator may have the need to work at either end of the press depending upon the specific garment being pressed. State of the art press closing systems have the close and lock buttons oriented in a fixed configuration which may render the close button inaccessible to an operator working at the "wrong" end of the press.

Other devices have been developed to close and lock a textile press while reducing or eliminating the chance of injury to the operator. Typical of the art are those devices disclosed in the following U.S. Patents:

| U.S. Pat. No. | Inventor(s) | Issue Date |
|---|---|---|
| 2,395,780 | Devol, Jr., G.C., et al. | Feb. 26, 1946 |
| 2,369,243 | Lechler, B.C. | Feb. 13, 1945 |

U.S. Pat. No. 2,395,780 discloses a capacity controlled textile press. Specifically, the '780 patent discloses a safety mechanism which includes an electric field generator having one electrode on the press head and another on the press buck. When the operator moves into the danger zone, the electric field is disrupted which prevents the press from closing.

U.S. Pat. No. 2,369,243 discloses a safety electric control for fluid-operated machines. The device requires the operator to press and hold two buttons to close the press. The two buttons are physically located at such a distance that both hands must be used. Once the press head reaches a closed position, both activators must be released substantially simultaneously to engage a lock mechanism. Releasing either button before the press head reaches the closed position or a significant delay in simultaneously releasing the buttons causes the press head to raise to the open position.

Accordingly, there is a need for a textile press which may be operated by a user working at either end of the press. Such a press would include ambidextrous closing and locking controls.

Therefore, it is an object of the present invention to provide a textile press having ambidextrous controls for closing and locking the press.

It is another object of the present invention to provide a textile press having a pair of interchangeable activators where the first activated activator closes the press head and the second activated activator locks the press head in the closed position.

BRIEF SUMMARY OF THE INVENTION

A textile press with an ambidextrous closing system configured with a pair of interchangeable activators for closing and locking a press head against a buck. An operator controls the press using a pair of activators spaced such that the operator is required to use both hands to simultaneously activate both activators. Further, a release activator is centrally located on the control panel to be easily accessible by the operator. The pair of activators is configured such that the first activator activated and held completes the press head closing circuit which causes the press head to engage the buck. Concurrently, the first activator to be activated partially completes the press control circuit. Once the press head engages the buck, activation of the remaining activator completes a press lock circuit locking the press head in engagement with the buck until the end of the pressing cycle, which is controlled automatically by a timer or manually by a separate release activator, at which time the press head returns to the open position.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A textile press with an ambidextrous closing system is illustrated generally at 10 in the figures. The textile press with an ambidextrous closing system, or press 10, is configured with a pair of interchangeable activators for closing and locking the press head against the buck.

Figure 1:
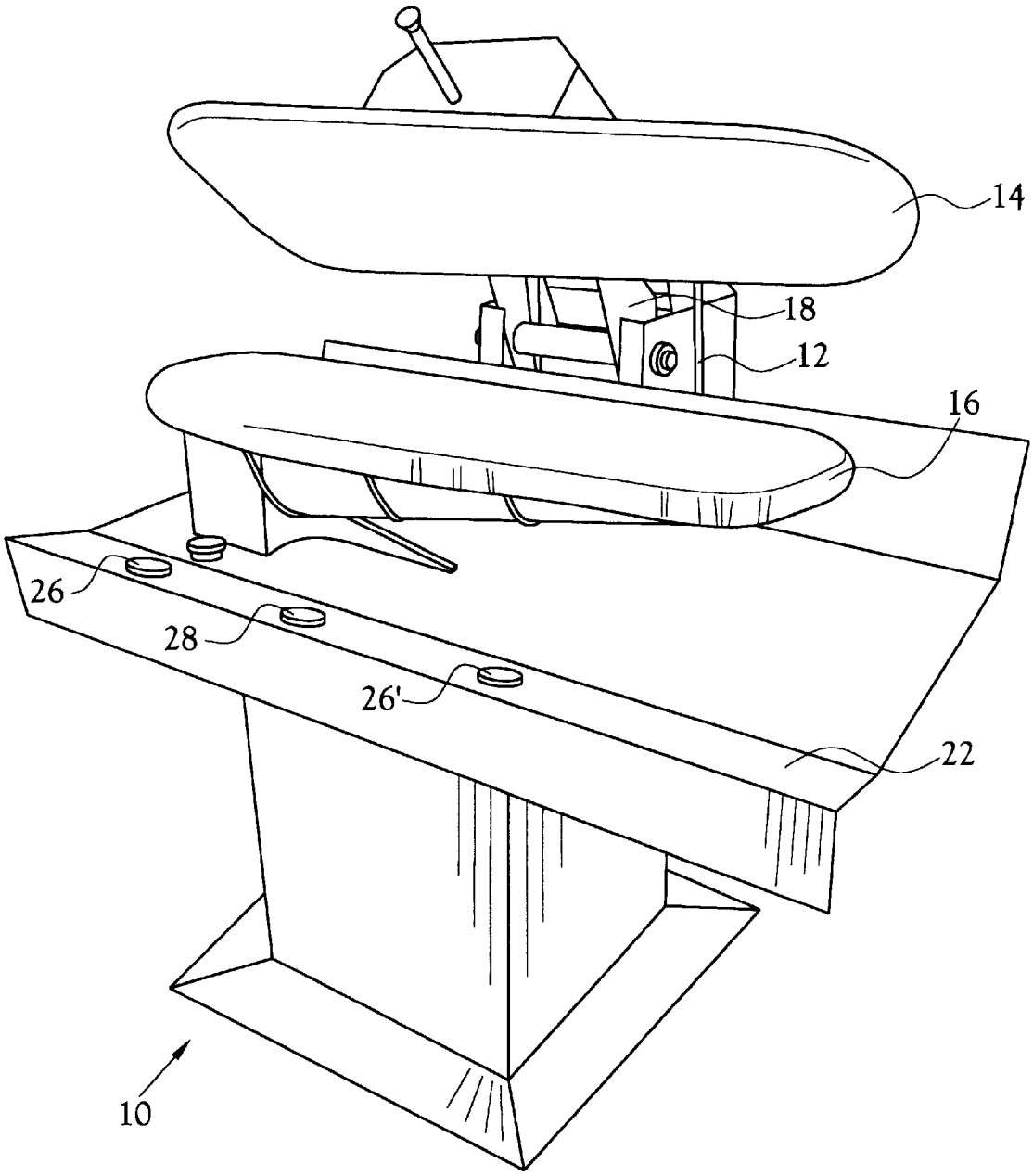
FIG. 1 is a perspective view of the press of the present invention.

FIG. 1 illustrates the structural features of one embodiment of a typical textile press 10 using a scissors type closing mechanism. One skilled in the art will recognize that other types of presses can be used, such as those using a fast-back type closing mechanism, without interfering with the objects of the present invention. In the illustrated embodiment, the press 10 includes a table 22 fixedly mounted to a frame 12. A buck 16 is fixedly mounted to the frame 12. A rocker arm 18, pivotally mounted to the frame 12, secures a press head 14 to the press 10 and permits the press head 14 to be moved in relation to the stationary buck 16. In the illustrated embodiment, the press head 14 is shown in the open position. A pair of activators 26, 26' control the closing and locking of the press head 14. The pair of activators 26, 26' is mounted on the table 22 and spaced such that an operator can not use a single hand to simultaneously activate both activators 26, 26' in order to close and lock the press head 14. More specifically, depression of either activators 26, 26' will close the press 10; however, both activators 26, 26' must be operated simultaneously to permit locking of the press 10. One skilled in the art will recognize that the pair of activators 26, 26' could be mounted on other surfaces without interfering with the objects of the present invention. A release activator 28, centrally located on the table 22, provides manual control of the unlocking and opening of the press head 14. The cooperating activators 26 are labeled with like numerals. Where distinction is required, the element number for the secondary activator is given the designation "26'".

Figure 2:
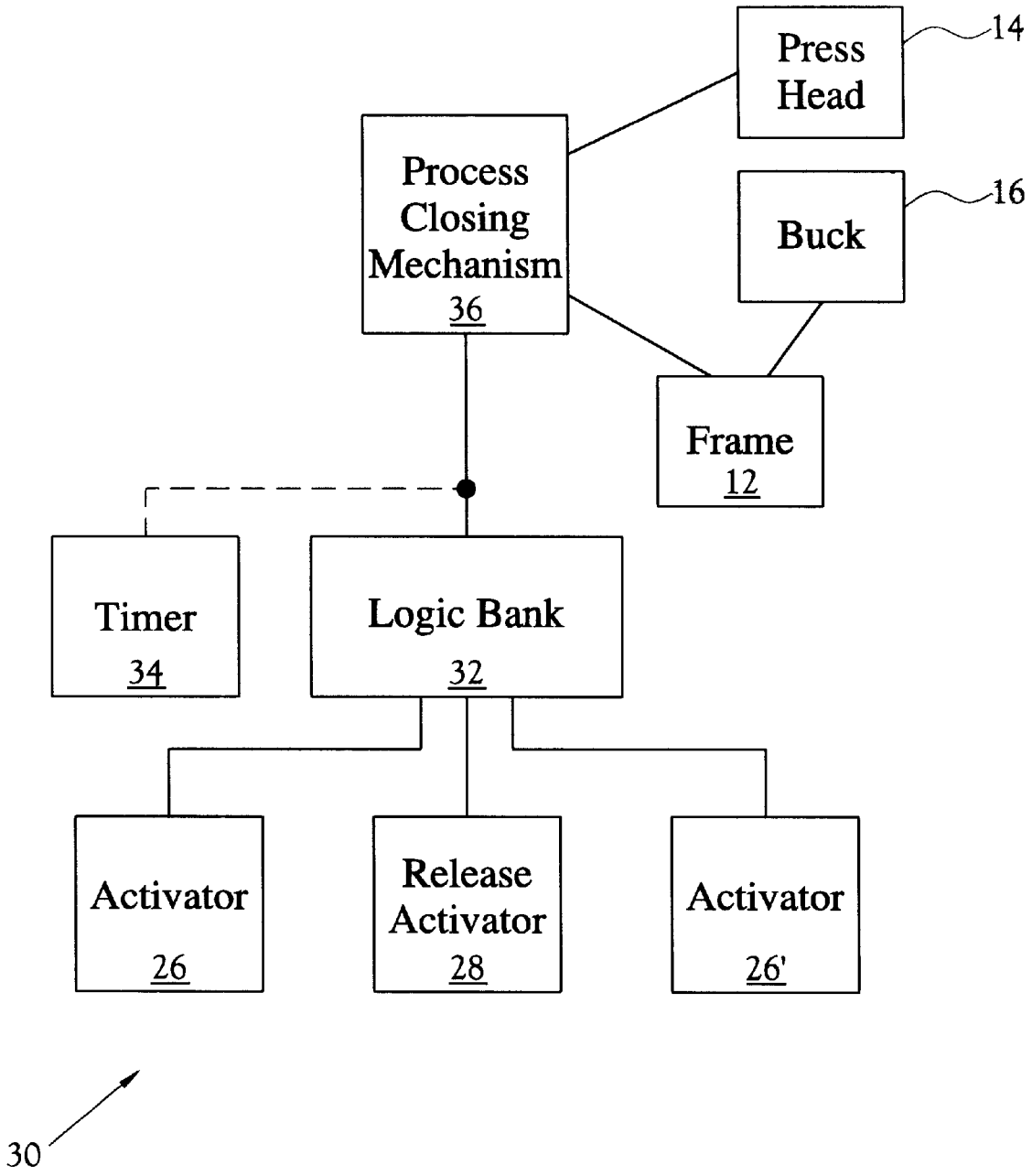
FIG. 2 is a block diagram of the press control circuit of the present invention.

FIG. 2 illustrates a block diagram of the press control circuit 30. The press control circuit 30 is operated using the pair of activators 26, and the release activator 28. Each of the activators 26, 26', 28 is connected to a logic bank 32. In one embodiment, the activators 26, 26', 28 are electrical switches and the logic bank 32 includes a plurality of electrical relays (not shown) which provide the logic to respond to activation of the appropriate activator 26, 26', 28. The logic bank 32 is electrically connected to a press closing mechanism 36 known to those skilled in the art. The logic bank 32 defines a plurality of logical circuits each having a specific function. When a first of the pair of activators 26 is activated, a first logical circuit is completed which closes the press 10. In addition, the logic bank 32 partially completes a second logical circuit for locking the press head 14. Operation of the other of the pair of activators 26' completes the second logical circuit. Once the press closing mechanism 36 brings the press head 14 into engagement with the buck 16 and the second logical circuit has been completed, the press head 14 is locked in the closed position. Heat and steam are applied as necessary to press the textiles.

Once the pressing cycle is complete, the press 10 opens by unlocking the press head 14 and disengaging the press head 14 from the buck 16. One skilled in the art will recognize that a timer 34 typically regulates the pressing cycle on machines equipped with automatic timing. However, the release activator 28 is generally provided as a manual override or may be provided for manual control in presses not including a timer 34. At the termination of the pressing cycle, the first logical circuit and the second logical circuit are broken at the logic bank 32 and a third logical circuit is completed. The third logical circuit unlocks the press head 14 and disengages the press head 14 from the buck 16.

In an alternate embodiment, the activators 26, 26', 28 are valves controlling the flow of a fluid into a pneumatic logic bank 32 including a plurality of fluid logic valves pneumatically connected to the press closing circuit 36.

The press 10 of the present invention permits greater efficiency by the machine operator. The press head 14 normally rests in the open position. The operator lays the textile to be pressed flat upon the buck 16. This typically requires the operator to move to either side of the press 10 in order to smooth wrinkles in the textile before the press head 14 is lowered. Accordingly, the press operator may be at either end of the press 10 when the textile is ready for pressing. Accordingly, with certain types of textiles, the operator may have to hold a portion of the textile with one hand while at the end of the press 10 until the press head 14 is brought into contact with the textile. With the present invention, the operator activates the closest of the pair of activators 26 to begin closing the press head 14. After the press head 14 closes, the operator can move to a central location in front of the table 22. When the press head 14 reaches the closed position where it engages the buck 16, the operator activates the remaining activator 26 while maintaining the activation of the first activated activator 26 thereby locking the press head 14 in the closed position. Steam and/or heat is applied as necessary to press the textile. At the completion of the pressing cycle, the timer 32 or the release activator 28 unlock the press head 14 and the press head 14 returns to the normally open position. The pressed textile is then removed from the press 10.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A circuit for controlling the closing and locking of a textile press comprising:

an actuator for moving a press head with respect to a buck;

a first logical circuit in communication with said actuator for moving the press head into engagement with the buck;

a second logical circuit in communication with said actuator for locking said actuator in a particular orientation;

a third logical circuit in communication with said actuator for breaking each of said first circuit and said second circuit, unlocking said actuator, disengaging the press head from the buck;

a pair of activators in communication with each of said first logical circuit and said second circuit, wherein activation of either of said pair of activators completes said first logical circuit and wherein activation of the other of said pair of activators completes said second logical circuit; and a release activator connected to said third logical circuit connected such that activating said release activator completes said third logical circuit.

2. The circuit of claim 1 further comprising a timing device in communication with said third logical circuit for timing a pressing cycle and completing said third logical circuit upon completion of the pressing cycle.

3. A textile press comprising:

a support frame;

a buck member fixedly connected to said support frame;

at least one rocker arm pivotally connected to said support frame;

a head member pivotally connected to said at least one rocker arm, said head member being contoured to couple with said buck member when engaged;

a moving mechanism connected to said at least one rocker arm for manipulating said rocker arm so as to move said head member in relation to said buck member;

a logic bank connected to said moving mechanism for controlling the direction of the moving mechanism;

a pair of activators disposed on said support frame and in communication with said logic bank for controlling said logical bank, said pair of activators being interchangeable, wherein one of said pair of activators being first operated communicates with said logic bank causing said logical bank to signal said moving mechanism to move said head member so to engage said buck member, wherein the other of said pair of activators, operated in conjunction with said first operated activator communicates with said logic bank causing said logic bank to signal said moving mechanism to lock said head member in position when said head member is in engagement with said buck member; and at least one release mechanism for unlocking said head member, disengaging said head member from said buck member, and returning said head member to an open position.

4. The textile press of claim 3 wherein said pair of activators are electrical switches and said logic bank comprises a plurality of electrical logic components.

5. The textile press of claim 4 wherein said plurality of electrical logic components are electrical relays.

6. The textile press of claim 3 wherein said pair of activators are pneumatic valves and said logic bank comprises a plurality of air logic components.

7. The textile press of claim 3 wherein said at least one release mechanism is a release activator in communication with said logic bank.

8. The textile press of claim 7 wherein said pair of activators and said at least one release activator are electrical switches and said logic bank comprises a plurality of electrical logic components.

9. The textile press of claim 7 wherein said pair of activators and said at least one release activator are pneumatic valves and said logic bank comprises a plurality of air logic components.

10. The textile press of claim 3 wherein said at least one release mechanism is a timer in communion with said logic bank.

11. A method for locking a press head of a textile press and in a closed position against a buck, said method comprising the steps of:

(a) activating either of a pair of activators to close a press head thereby defining a first activated activator;

(b) waiting for the press head to engage a buck; and (c) activating the other of said pair of activators while the first activated activator remains activated to lock the press head in a closed position against the buck.

12. A method for locking a press head of a textile press and in a closed position against a buck, said method comprising the steps of:

(a) activating either of a pair of activators which completes a first logical circuit which moves a press head into a closed position engaging a buck; and (b) activating the remaining of said pair of activators which completes a second logical circuit which locks the press head in the closed position.

* * * * *